US007307598B2

(12) United States Patent
Shigihara

(10) Patent No.: US 7,307,598 B2
(45) Date of Patent: Dec. 11, 2007

(54) ANTENNA DEVICE HAVING ENHANCED RECEPTION SENSITIVITY IN WIDE BANDS

(75) Inventor: Makoto Shigihara, Fukushima-ken (JP)

(73) Assignee: ALPS Electric Co., Ltd., Ota-Ku, Tokyo (JP)

( * ) Notice: Subject to any disclaimer, the term of this patent is extended or adjusted under 35 U.S.C. 154(b) by 0 days.

(21) Appl. No.: 11/361,529

(22) Filed: Feb. 24, 2006

(65) Prior Publication Data

US 2006/0139226 A1 Jun. 29, 2006

(51) Int. Cl.
*H01Q 7/08* (2006.01)

(52) U.S. Cl. ..... 343/788; 343/744

(58) Field of Classification Search ..... 343/744, 343/787, 788, 895
See application file for complete search history.

(56) References Cited

U.S. PATENT DOCUMENTS

| | | | | |
|---|---|---|---|---|
| 3,427,624 | A | 2/1969 | Wanselow et al. | |
| 3,573,840 | A | 4/1971 | Gouillou et al. | |
| 3,946,397 | A | 3/1976 | Irwin | |
| 4,148,036 | A * | 4/1979 | Miller | 343/788 |
| 4,407,000 | A * | 9/1983 | Sasaki et al. | 343/726 |
| 5,767,816 | A * | 6/1998 | Cosman | 343/788 |
| 6,163,305 | A * | 12/2000 | Murakami et al. | 343/788 |
| 6,529,169 | B2 * | 3/2003 | Justice | 343/788 |
| 6,650,303 | B2 * | 11/2003 | Kim et al. | 343/895 |
| 7,071,887 | B2 * | 7/2006 | Shigihara et al. | 343/744 |
| 2002/0190906 | A1 | 12/2002 | Kim et al. | |
| 2006/0139227 | A1 * | 6/2006 | Shigihara | 343/788 |

FOREIGN PATENT DOCUMENTS

| | | |
|---|---|---|
| EP | 1557902 A1 | 7/2005 |
| JP | 51-83755 | 7/1976 |

OTHER PUBLICATIONS

European Search Report dated Apr. 6, 2006 from corresponding European Application No. 06003972.4-2220.

* cited by examiner

*Primary Examiner*—Tan Ho
(74) *Attorney, Agent, or Firm*—Beyer Weaver LLP

(57) ABSTRACT

An antenna device includes a prism-shaped or plate-shaped base member made of a dielectric or magnetic material, band-shaped first and second radiation conductors wound around the base member and connected to each other, and a third radiation conductor wound around the base member and connected to the second radiation conductor. The first and second radiation conductors include a plurality of divided portions, and the divided first radiation conductor portions are connected in series by first variable capacitance elements, the divided second radiation conductor portions are connected in series by second variable capacitance elements, and a node between the first and second radiation conductors is used as a feeding end.

3 Claims, 3 Drawing Sheets

ANTENNA DEVICE HAVING ENHANCED RECEPTION SENSITIVITY IN WIDE BANDS

BACKGROUND OF THE INVENTION

1. Field of the Invention

The present invention relates to an antenna device that can be tuned to wide band frequencies.

2. Description of the Related Art

A known antenna device 10 is described with reference to FIGS. 4 and 5. A conductor 12 made of a fine metal wire is spirally wound around a ferrite magnetic core 14. Ends of the spiral conductor 12 form connection terminals 16 and 18. The spiral conductor 12 includes a plurality of divided conductor portions 12', and the conductor portions 12' are connected to one another by a plurality of capacitance elements 20. As shown in FIGS. 4 and 5, the antenna device 10 is such that the capacitance elements 20 are physically distributed in the spiral conductor 12 to have a closed loop form. The antenna device 10 responds to a particular frequency (see, for example, Japanese Unexamined Patent Application Publication No. 51-83755 (FIGS. 1 and 3) and its corresponding U.S. Pat. No. 3,946,397).

The known antenna device resonates with a particular frequency. Thus, when the known antenna device receives over wide bands, its reception sensitivity in frequencies other than the particular frequency decreases.

SUMMARY OF THE INVENTION

It is an object of the present invention to provide an antenna device by which good reception sensitivity can automatically be obtained in wide bands.

According to an aspect of the present invention, an antenna device is provided which includes a prism-shaped or plate-shaped base member made of a dielectric or magnetic material, band-shaped first and second radiation conductors wound around the base member and connected to each other, and a band-shaped third radiation conductor wound around the base member and connected to the second radiation conductor. The first and second radiation conductors are respectively formed by a plurality of divided first radiation conductor portions and a plurality of divided second radiation portions, and the divided first radiation conductor portions are connected in series by first variable capacitance elements. The divided second radiation conductor portions are connected in series by second variable capacitance elements, and a node between the first and second radiation conductors is used as a feeding end.

Preferably, the first radiation conductor resonates with a high range of the UHF band within a variable capacitance range of the first variable capacitance elements, and a series radiation conductor comprising the second and third radiation conductors resonates with a low range of the UHF band within a variable capacitance range of the second variable capacitance elements.

The variable capacitance elements may include varactor diodes, and a tuning voltage may be applied to each varactor diode through each radiation conductor.

According to the present invention, an antenna device includes a prism-shaped or plate-shaped base member made of a dielectric or magnetic material, band-shaped first and second radiation conductors wound around the base member and connected to each other, and a band-shaped third radiation conductor wound around the base member and connected to the second radiation conductor. The first and second radiation conductors are respectively formed by a plurality of divided first radiation conductor portions and a plurality of divided second radiation conductor portions are connected in series by first variable capacitance elements. The divided second radiation conductor portions are connected in series by second variable capacitance elements, and a node between the first and second radiation conductors is used as a feeding end. Thus, resonations with two frequencies can be established and each resonant frequency can be changed.

In addition, according to the present invention, the first radiation conductor resonates with a high range of the UHF band within a variable capacitance range of the first variable capacitance elements, and a series radiation conductor comprising the second and third radiation conductors resonates with a low range of the UHF band within a variable capacitance range of the second variable capacitance elements. Television signals in two ranges of the UHF band can be received.

In addition, according to the present invention, the variable capacitance elements may include varactor diodes, and a tuning voltage may be applied to each varactor diode through each radiation conductor. Thus, television signals in two ranges can simultaneously be received.

DESCRIPTION OF THE PREFERRED EMBODIMENTS

Figure 1:
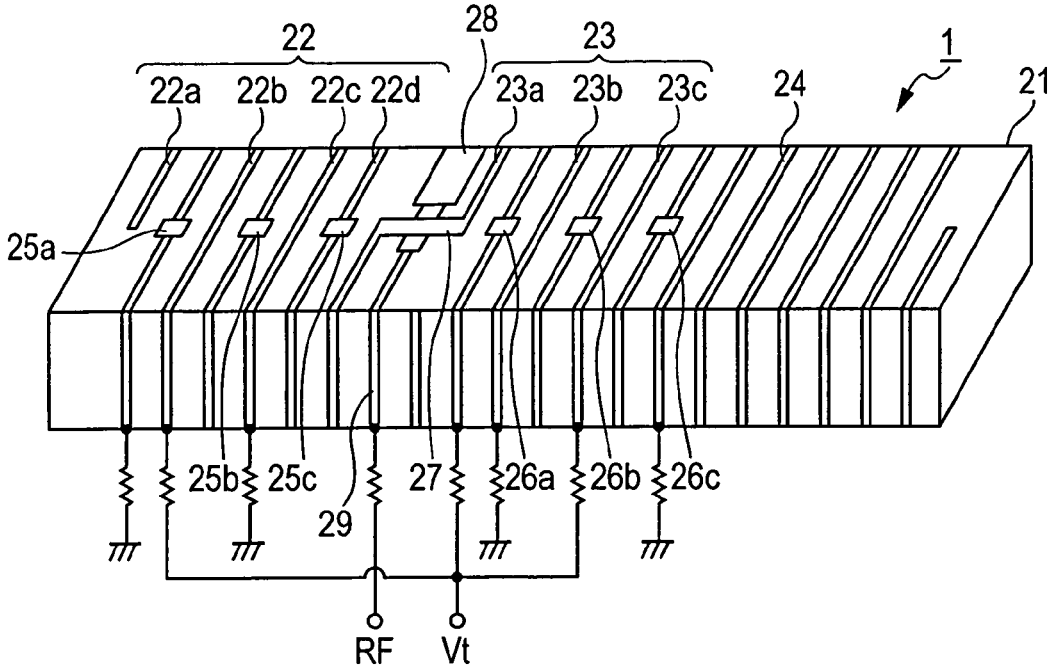
FIG. 1 is a perspective view of an antenna device of the present invention.
Figure 2:
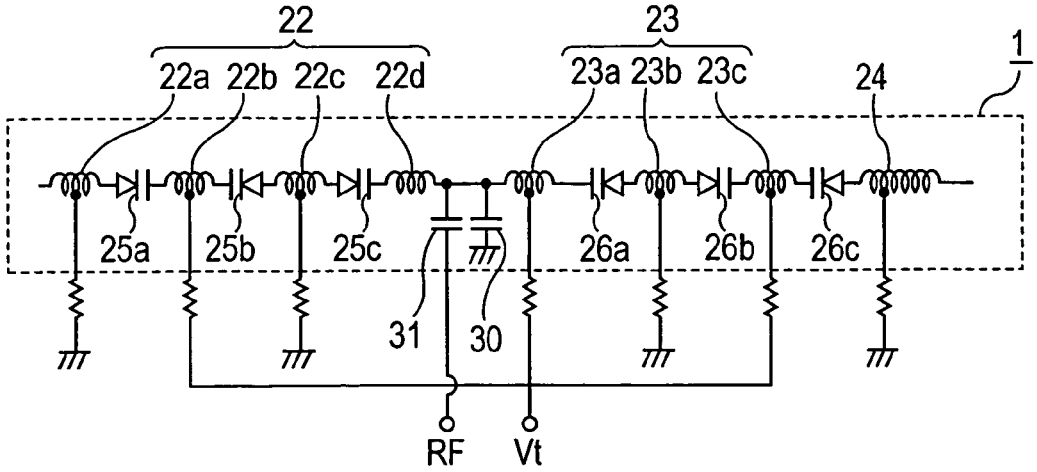
FIG. 2 is an equivalent circuit diagram of the antenna device of the present invention.
Figure 3:
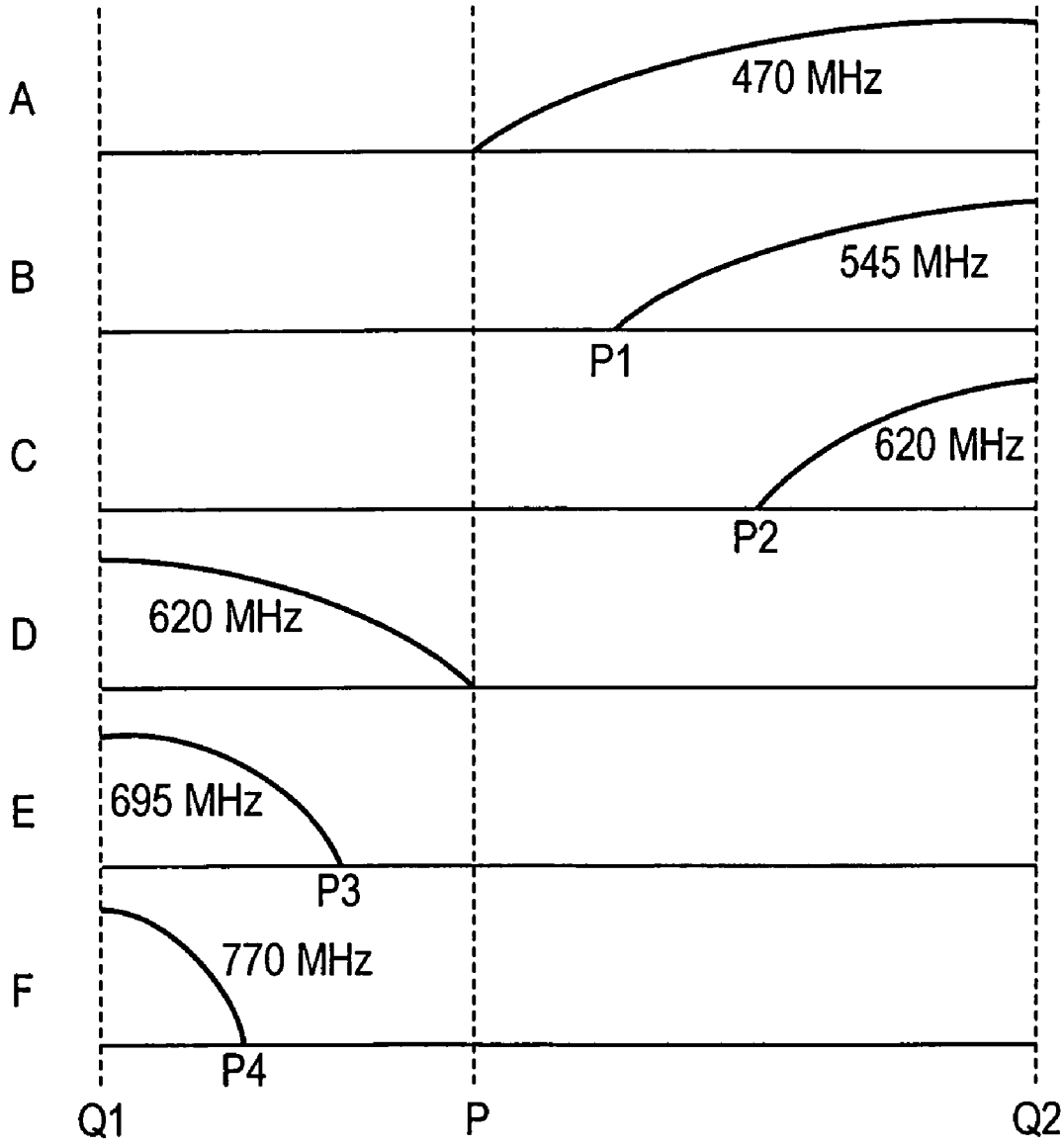
FIG. 3 is a voltage distribution graph of the antenna device of the present invention.
Figure 4:
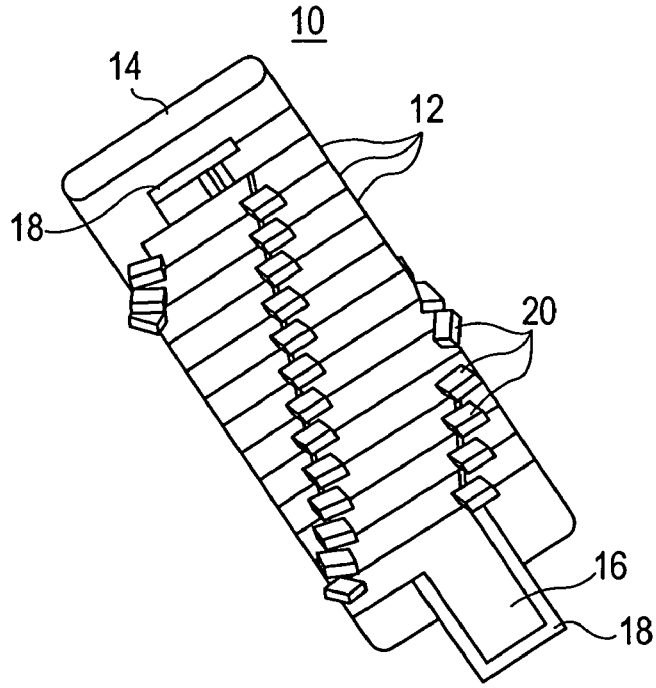
FIG. 4 PRIOR ART
FIG. 4 is a perspective view of a known antenna device.
Figure 5:
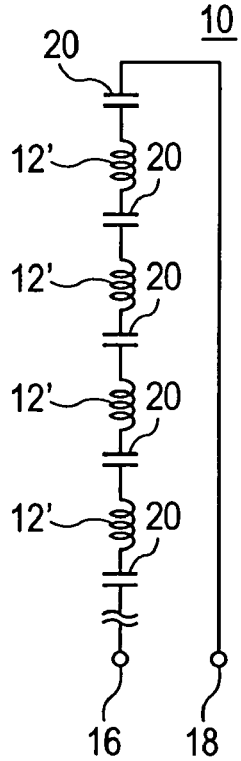
FIG. 5 PRIOR ART
FIG. 5 is an equivalent circuit diagram of the known antenna device.

An antenna device 1 of the present invention is described below with reference to FIGS. 1 to 3. FIG. 1 is a perspective view of the antenna device 1, and FIG. 2 is an equivalent circuit of the antenna device 1. FIG. 3 shows a voltage distribution in the antenna device 1.

In FIGS. 1 and 2, band-shaped first and second radiation conductors 22 and 23 are wound around a base member 21 having, for example, a prism or plate shape, and which is formed of a dielectric or magnetic material, and are connected to each other. A third radiation conductor 24 is connected to the second radiation conductor 23, and is also wound around the base member 21. The first radiation conductor 22 is formed by a plurality of divided portions. Among divided first radiation conductor portions 22*a*, 22*b*, 22*c*, and 22*d*, two adjacent conductor portions are connected to each other by each of first variable capacitance elements (varactor diodes) 25 (25*a* to 25*c*).

Similarly, the second radiation conductor 23 is also formed by a plurality of divided portions. Among divided second radiation conductor portions 23*a*, 23*b*, and 23*c*, two adjacent conductors are connected to each other by each of second variable capacitance elements (varactor diodes) 26 (26*a* to 26*c*). The third radiation conductor 24 is connected to the second radiation conductor 23*c* by the variable capacitance element 26*c*. The first variable capacitance element 25 and the second variable capacitance element 26 are provided on an upper surface of the base member 21.

The first radiation conductor portion 22*d* and the second radiation conductor portion 23*a* are connected to each other by a connection conductor 27 formed on the upper surface of the base member 21. In the vicinity of the connection conductor 27, a ground conductor 28 and a feeding conductor 29 are formed. The ground conductor 28 and the feeding conductor 29 extend to side surfaces of the base member 21. The connection conductor 27 is connected to the ground conductor 28 by an impedance-matching capacitor 30 and is connected to the feeding conductor 29 by a coupling capacitor 31.

The antenna device 1 having the above-described configuration is used in, for example, a portable device (e.g., a cellular phone) assumed to receive analog television broadcasting or digital terrestrial broadcasting, and is mounted on a motherboard (not shown) of the portable device. The feeding conductor 29 is connected to a tuner circuit (RF) formed on the motherboard. A tuning voltage Vt is supplied from the motherboard to the first radiation conductor portion 22*b*, and the second radiation conductor portions 23*a* and 23*c* through resistors. The first radiation conductor portions 22*a* and 22*c*, the second radiation conductor portion 23*b*, and the third radiation conductor 24 are grounded for DC on the motherboard by resistors. This applies the tuning voltage Vt between two ends of the first variable capacitance elements 25 and between two ends of the second variable capacitance elements 26.

The connection conductor 27 serves as a feeding end P, an end of the first radiation conductor portion 22*a* serves as a first open end Q1, and an end of the third radiation conductor 24 serves as a second open end Q2.

An electrical length of the first radiation conductor 22 is set so that a resonance occurs with a high range (for example, 620 MHz to 770 MHz) of the UHF band within a variable capacitance range of each first variable capacitance element 25. An electrical length of the entirety of the second radiation conductor 23 and the third radiation conductor 24 is set so that a resonance occurs with a low range (for example, 470 MHz to 620 MHz) of the UHF band within a variable capacitance range of the first variable capacitance element 26.

FIG. 3 shows voltage distributions between the positions of the feeding end P and the first open end Q1, and voltage distributions between the positions of the feeding end P and the second open end Q2. The positions of the first open end Q1 and the second open end Q2 always have maximum voltages, and the positions of minimum voltages change correspondingly to resonant frequencies.

Part A of FIG. 3 shows a voltage distribution in the case of a resonance with 470 MHz in the low band, and the position of the minimum voltage is the position of the feeding end P. By decreasing the capacitance of the second variable capacitance elements 26 to establish a resonance with 545 MHz, a minimum voltage point P1 is moved to the position of the second open end Q2. Establishing a resonance with 620 MHz moves a minimum voltage point P2 to the position of the second open end Q2, as shown in part C of FIG. 3. This position P2 serves as a node between the second radiation conductor 23 and the third radiation conductor 24.

When establishing a resonance with a minimum frequency of 620 MHz in the high band by using the first radiation conductor 22, as shown in part D of FIG. 3, the minimum voltage point is the position of the feeding end P. However, establishing a resonance with 695 MHz moves the position P3 of the minimum voltage point to the first open end Q1, and establishing a resonance with 770 MHz moves the position P4 of the minimum voltage point to the first open end Q1.

Since the same tuning voltage is applied to the first variable capacitance elements 25 and the second variable capacitance elements 26, television signals on two channels corresponding to the high band and the low band are input to the tuner circuit. Therefore, a television signal in either band can arbitrarily be selected in the tuner circuit without switching the bands.

What is claimed is:

1. An antenna device comprising:

a prism-shaped or plate-shaped base member made of a dielectric or magnetic material;

band-shaped first and second radiation conductors wound around the base member and connected to each other; and a band-shaped third radiation conductor wound around the base member and connected to the second radiation conductor, wherein:

the first and second radiation conductors are respectively formed by a plurality of divided first radiation conductor portions and a plurality of divided second radiation conductor portions, and the divided first radiation conductor portions are connected in series by first variable capacitance elements; and the divided second radiation conductor portions are connected in series by second variable capacitance elements, and a node between the first and second radiation conductors is used as a feeding end.

2. The antenna device according to claim 1, wherein:

the first radiation conductor resonates with a high range of the UHF band within a variable capacitance range of the first variable capacitance elements; and a series radiation conductor comprising the second and third radiation conductors resonates with a low range of the UHF band within a variable capacitance range of the second variable capacitance elements.

3. The antenna device according to claim 1, wherein the variable capacitance elements comprise varactor diodes, and a tuning voltage is applied to each varactor diode through each radiation conductor.

* * * * *